United States Patent [19]

Daus

[11] 4,281,479

[45] Aug. 4, 1981

[54] INTERNAL DOOR LOCK SECURITY REINFORCEMENT AND METHOD OF ASSEMBLY

[75] Inventor: Ronald R. Daus, McKenzie, Tenn.

[73] Assignee: Republic Steel Corporation, Cleveland, Ohio

[21] Appl. No.: 131,162

[22] Filed: Mar. 17, 1980

[51] Int. Cl.[3] ..... E06B 3/00

[52] U.S. Cl. ..... 49/503

[58] Field of Search ..... 49/503, 501, 394; 292/DIG. 17

[56] References Cited

U.S. PATENT DOCUMENTS

| | | | |
|---|---|---|---|
| 2,948,366 | 8/1960 | Kelly et al. | 49/501 |
| 3,250,041 | 5/1966 | Anger | 49/501 |
| 3,383,802 | 5/1968 | Janssens | 49/503 |
| 3,512,305 | 5/1970 | Multer | 49/503 |
| 3,623,757 | 11/1971 | Schlage | 49/503 X |
| 3,633,312 | 1/1972 | Yeager | 49/503 |
| 3,821,884 | 7/1974 | Walsh . | |
| 3,894,357 | 7/1975 | Stanfield | 49/503 |
| 3,987,588 | 10/1976 | Imperial et al. | 49/501 |
| 4,118,895 | 10/1978 | Governale | 49/503 |
| 4,218,848 | 8/1980 | Nelson | 49/503 |

*Primary Examiner*—Philip C. Kannan

*Attorney, Agent, or Firm*—Emory L. Groff, Jr.

[57] ABSTRACT

A hollow door containing a core or filler is provided with a door lock security reinforcement which is assembled by means of a series of steps accomplished subsequent to fabrication of a core filled door. The assembly is achieved by forming a bore through the core extending from a horizontally aligned lock provision and hinge provision. One end of a security tube inserted within the core bore engages a positioner element in turn engaging a subsequently installed lock set while the other end of the security tube is precluded from outward axial displacement by the overlying fixation of a hinge leaf to the hinge provision.

11 Claims, 5 Drawing Figures

INTERNAL DOOR LOCK SECURITY REINFORCEMENT AND METHOD OF ASSEMBLY

This invention relates generally to hollow doors having a lock set and provided with internal lock security reinforcement and also is directed to an improved method of assembling the reinforcement.

Security against unwarranted access to rooms or buildings may most readily be provided by means of hollow, metal-clad doors particularly in an industrial or commercial environment. Basically, such doors comprise a metal edge channel bounded on either side by a sheet metal panel or skin. Additional strength must be provided within the interior of these hollow doors, if for no other reason than to preclude deformation of the metal panels in a direction perpendicular to the face thereof. Various filler structure has been employed in previous doors for the interior thereof. Such fillers may comprise a honeycomb core filling the complete interior of the door or alternatively, the core may comprise a cellular, expanded synthetic plastic foam composition which may be foamed and sized prior to insertion within the edge channel of the door or may be foamed in situ after application of the two sheet metal panels to the edge channel. The advantages of either a honeycomb or foam core will be readily apparent. Each provides a core offering an extremely high strength to weight ratio while offering excellent sound and heat absorbing characteristics.

Other methods have also been employed to provide the required strength within the interior of a hollow metal door and include the utilization of various numbers of metal channels or stiles spanning either or both the horizontal and vertical edge channels of the door. The door interior metal reinforcement has also been combined with a light-weight filler such as the previously described honeycomb or foamed plastic core and quite obviously, the number of interior metal channels or stiles is restricted due to the material cost, fabrication and labor involved with a plurality of additional metal components and additionally, due to the substantial increased weight of a finished door containing a plurality of metal stiles therein.

In any case, it has been found that the security, as provided by the lock set mounted within a hollow door may be readily circumvented. Prior to the development of the present lock security reinforcement and method of assemblying same, tests were conducted on existing hollow metal doors and it was found that little effort was required to deform or radially displace the medial portion of the lock set within the interior of the door and with this displacement there was sufficient retraction of the lock bolt from the adjacent frame to allow opening of the door. Such unwarranted entry has been readily achieved by the application of any suitable leverage tool such as a pry bar or sizeable piece of lumber inserted between the exposed door knob and adjacent door frame and which resulted in radial displacement of the cylindrical lock case disposed within the interior of the door between the two panels or skins.

By the present invention an improved security reinforcement structure and method of assembly therefor is provided which structure and method may be applied to a hollow metal door after it has been fabricated. This invention is particularly adaptable to a hollow metal door which has been provided with a foam core and includes the installation of an elongated spanner element or security tube within the interior of the core body and which is horizontally aligned with one end thereof juxtaposed the cylindrical lock case of the door lock set and the other end thereof co-located with the hinge provision associated with the door hinge channel. The inner end of the security tube engages and supports a positioner element juxtaposed the cylindrical lock case and is fixedly retained in a stationary position upon the assembly of a hinge leaf in an overlying relationship juxtaposed the outer end of the security tube.

Accordingly, one of the objects of the present invention is to provide an improved internal door lock security reinforcement for a hollow door including an elongated spanner element having an inner end juxtaposed the door lock case and an outer end engageable with a hinge provision horizontally aligned with the lock case.

Another object of the present invention is to provide an improved method of assemblying a door lock security reinforcement within the interior of a hollow door subsequent to fabrication of the door.

A further object of the present invention is to provide an improved lock security reinforcement for a hollow door including an axially anchored security tube disposed through the core within the door with its inner end engageable with a positioner element mating with the periphery of the lock case.

Still another object of the present invention is to provide an improved method of assemblying a lock security reinforcement within a previously fabricated hollow metal door containing a core including, boring in the core a hollow passageway extending horizontally between a hinge provision on the door channel to the lock case disposed within the interior of the door followed by the insertion of an elongated spanner element extending from the lock case to the hinge provision.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several views of the drawings.

Figure 1:
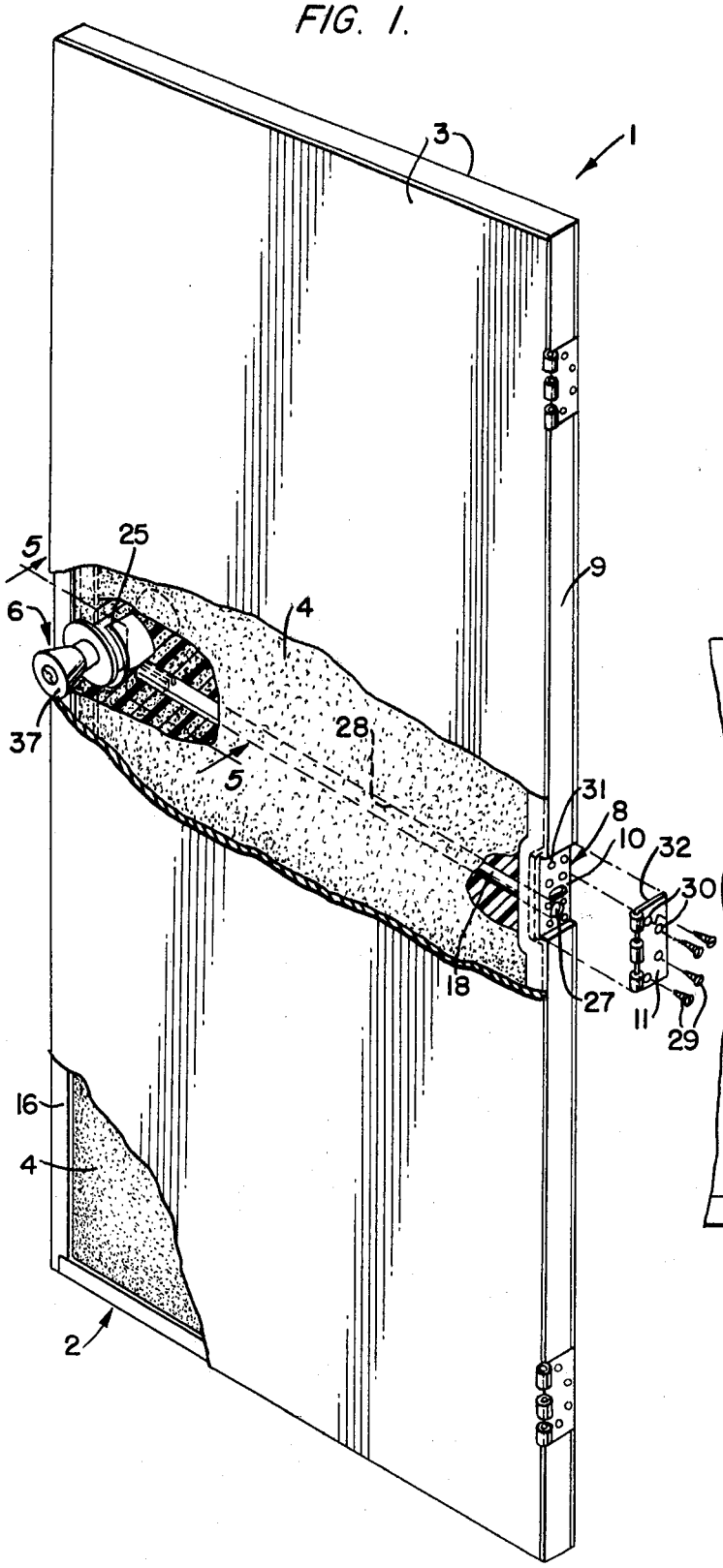
FIG. 1 is a perspective view of a hollow door with portions broken away to illustrate the security reinforcement of the present invention.

Referring now to the drawings, particularly FIG. 1, the present invention will be seen to relate to a hollow door generally designated 1 and especially a door constructed with a peripheral edge channel 2 bounded by opposite metal panels or skins 3—3. The hollow interior of the door 1 is provided with an appropriate filler such as the core 4 which may be of an expanded synthetic plastic foam of well known composition. From the standpoint of the present invention, it will be understood that it is immaterial whether the core 4 is preformed prior to sizing and insertion within the confines of the edge channel or alternatively, foamed in situ following assembly of the panels 3—3 to the surrounding edge channel 2.

At the time the core 4 is provided within the interior of the door a void or lock receiving cavity 5 is provided in the area intended to receive the subsequently applied lock set 6. If the core is foamed in situ then an appropriate dam or barrier 7 may be provided with the interior of the door to insure the formation of the lock receiving cavity 5 at the desired location such as shown in FIG. 5 of the drawings.

Figure 2:
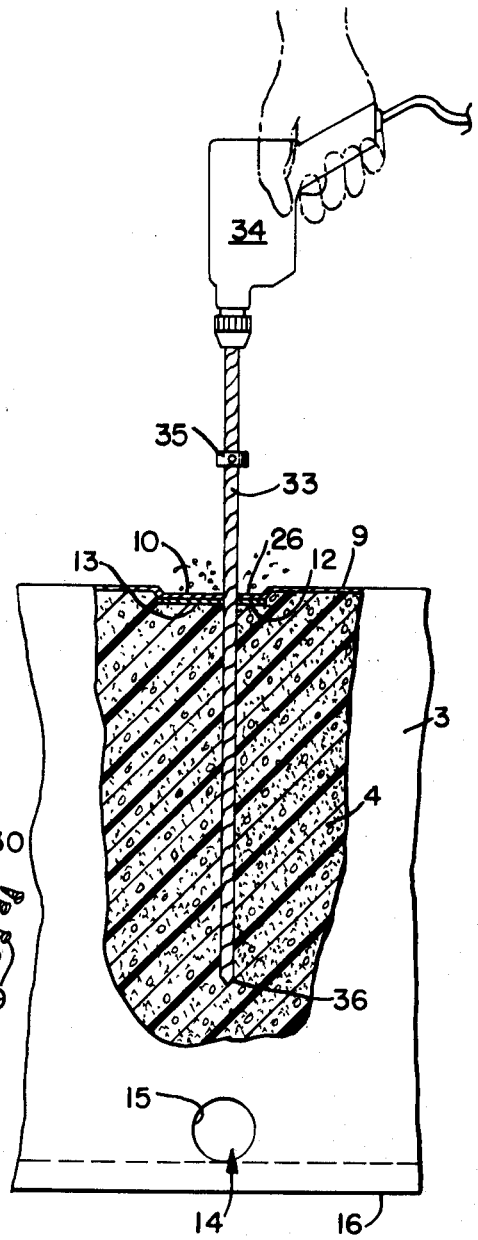
FIG. 2 is a fragmentary front elevation with portions broken away and illustrates the initial step during installation of the invention.
Figure 3:
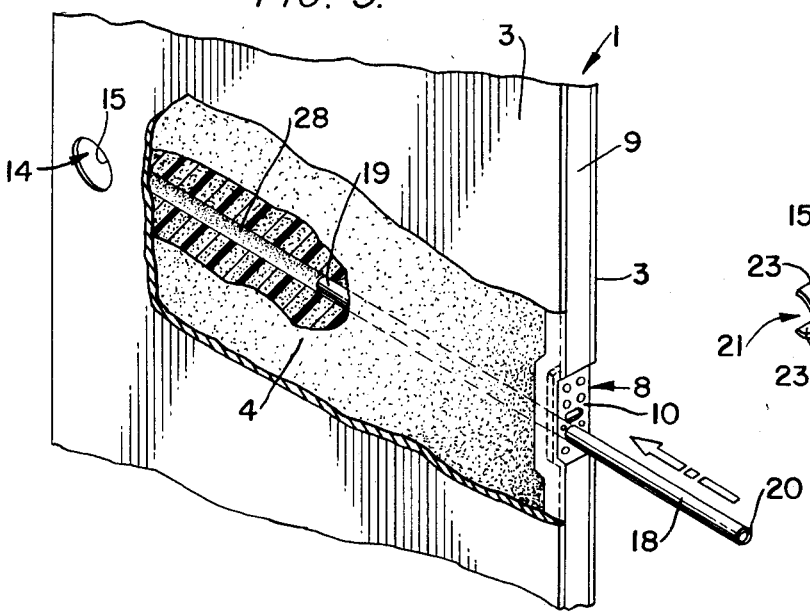
FIG. 3 is a fragmentary perspective view with portions broken away illustrating the second step leading to installation of the present invention.

As previously mentioned, the door lock security reinforcement according to the present invention is particularly desirable inasmuch as its installation may be accomplished subsequent to the initial fabrication of the hollow metal door. It will be understood that these doors are usually shipped from the manufacturer with an appropriate number of hinge provisions 8 formed within the hinge channel 9. As will be seen most clearly from FIGS. 1 and 2 of the drawings, each such hinge provision 8 comprises an inwardly recessed planar hinge mount 10 which actually may comprise an integral deformation of the hinge channel 9 itself. In order to provide adequate support for the subsequently applied hinge leaf 11, a hinge mount reinforcing plate or back-up plate 12 may be welded or otherwise attached to the interior surface 13 of the hinge mount 10. Additionally, hollow metal doors are usually shipped from the manufacturer with a standard lock provision 14 which provision includes a cylindrical lock set opening 15 formed in both panels 3—3 adjacent the door lock channel 16. The lock provision of course, further includes a standard bolt opening 17 through the adjacent lock channel 16 as shown in FIG. 5 of the drawings.

To incorporate the instant invention in any hollow metal door as described hereinabove it is only necessary to insure that one of the hinge provisions 8 is located along the hinge channel 9 at a point which is horizontally aligned with the lock provision 14 for reasons which will become obvious hereinbelow.

Figure 4:
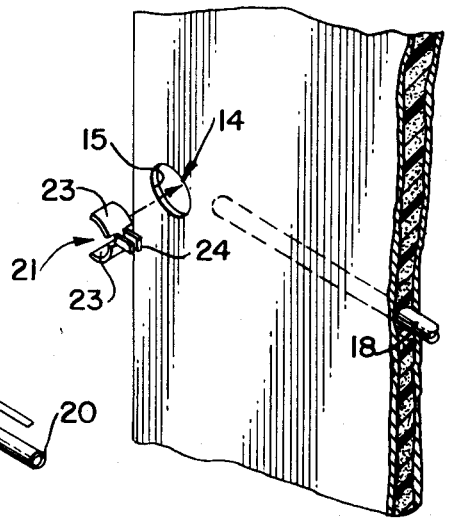
FIG. 4 is a fragmentary perspective view illustrating installation of the positioner element of the present invention.
Figure 5:
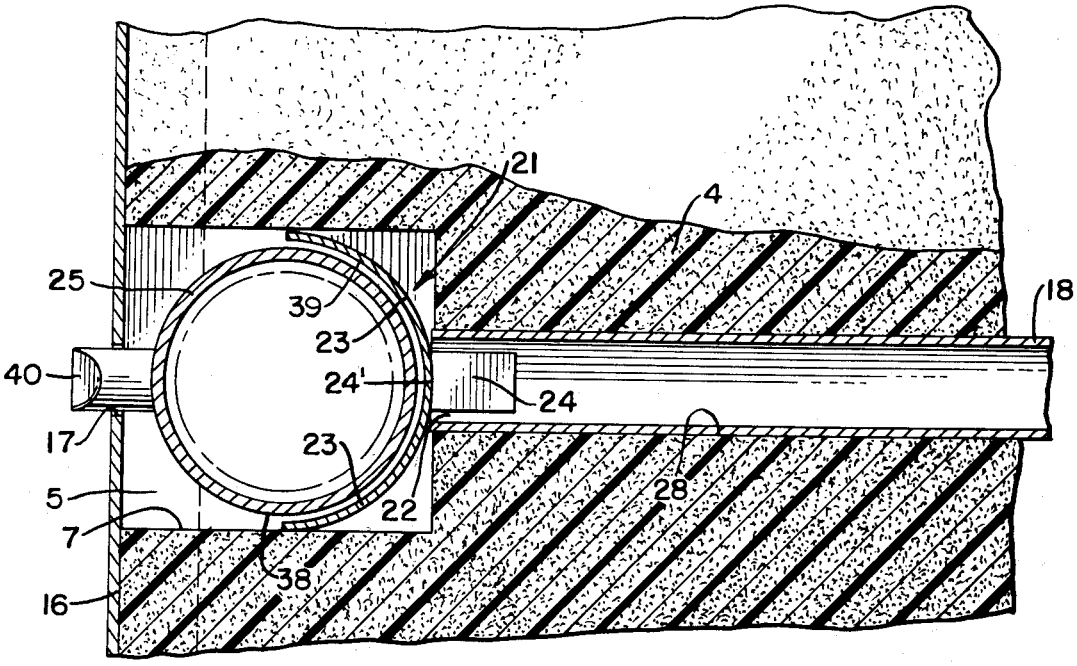
FIG. 5 is an enlarged fragmentary front elevation taken along the line 5—5 of FIG. 1 with portions broken away and in section and illustrates the positioner element and security tube as they appear just prior to final assembly.

The lock security reinforcement of the present invention comprises two primary components namely, an elongated spanner element or security tube 18 having an inner lock end 19 and an outer hinge end 20 and which is adapted to cooperate with a positioner element 21 shown most clearly in FIGS. 4 and 5 of the drawings. The security tube 18 most economically may be a hollow member but alternatively may include a lightweight solid rod provided with at least a cavity or recessed opening 22 communicating with the inner lock end 19 for reasons which will become obvious hereinafter.

The positioner element 21 includes a pair of arcuate arms 23—23 joined to an intermediate or central web 24' from which extends rearwardly, a pair of attachment tabs 24. For ease of manufacture the positioner element 21 is preferably constructed from a single piece of material with the aforementioned tabs 24 being cut therefrom and the arcuate arms 23 subsequently being curved to define a single constant radius arc coinciding with the radius of curvature of the cylindrical lock case 25 which will be disposed within the interior of the door. The height of and the distance between the two attachment tabs 24—24 are selected to insure a close sliding fit when disposed within the end opening 22 of the security tube 18.

With the security tube 18 and positioner element 21 assembled as described above and as shown in FIG. 1 of the drawings, it will be understood that the outer hinge end 20 of the security tube 18 will be flush with the outer surface 26 of the recessed hinge mount 10 and disposed through an opening 27 previously provided in the hinge mount. If a plurality of hollow doors 1 are to be simultaneously provided with the security reinforcement of the present invention and all of the doors are of the same dimensions then, a plurality of the security tubes 18 may initially be provided in a pre-cut condition to insure that the outer hinge end 20 is flushly disposed with the outer surface 26 of the hinge mount 10 when properly installed. However, it may be more convenient to utilize long lengths of tube stock from which a plurality of custom cut security tubes 18 may be obtained. In the latter instance, the inner end 19 of the tube is inserted through a previously formed bore 28 in the core until the positioner element tabs 24 are fully nested therewithin and the positioner is tightly abutting the lock case 25 after which so much of the tube stock as projects beyond the outer surface 26 of the hinge mount 10 is cut off with a suitable tool such as a hack saw.

With the structure as described above in mind, it will be seen that the horizontally disposed security tube 18 provides a rigid elongated metal element fixedly engaging on the one end through the positioner element 21, the periphery of the cylindrical lock case 25 while the other end is flushly disposed with the outer surface 26 of the recessed hinge mount 10. Accordingly, any outside effort applied in an attempt to radially displace the lock case 25 away from the adjacent lock channel 16 and towards the hinge provision 8 of the hinge channel 9 would meet with resistance offered by the horizontally disposed security tube 18. This security tube is prevented from any axial displacement toward the hinge channel 9 by the application of the hinge leaf 11 to the hinge mount 10 by means of appropriate fasteners such as the screws 29 disposed through screw attachment holes 30 in the hinge leaf 11 and the underlying back-up plate 12. With the foregoing in mind it will be appreciated that the inner surface 32 of the hinge leaf 11 will abut the outer hinge end 20 of the security tube 18 and thus, preclude any travel or displacement of the security tube in an outward direction away from the lock set 6. In certain installations it may be necessary or at least desirable to include a spacer or filler plate (not shown) intermediate the hinge leaf 11 and hinge mount 10 and in such case, the operation of the invention is not changed since the filler plate acts merely as an extension of the hinge leaf 11 itself.

A preferred method of assemblying of the components of the present invention may now be discussed. The fabricated hollow door will be considered to include the foamed core 4 and a standard lock provision 14 disposed in a plane horizontally aligned with the medial hinge provision 8. It is first necessary to provide the horizontal core bore 28 medially disposed within the thickness of the core 4 with the center line of the bore 28 passing through the center of the axes of the lock set openings 15 on the one hand and through a point intermediate the screw mounting holes 31 formed in the hinge provision 8 at the other end. This bore 28 may be formed by either a hole saw or an extension bit 33 such as shown chucked in the drill 34 in FIG. 2 of the drawings. The security tube opening 27 through the hinge provision 8 of the hinge channel 9 may be formed previously or may be provided at the same time the core bore 28 is made. in any case, it will be understood that the bore 28 extends transversely throughout the core 4 from the hinge provision opening 27 to the lock receiving cavity 5. By providing an appropriate stop 35 on the bit 33 automatic means will be offered to insure that the tip 36 of the drill bit will not be advanced into engagement with the lock channel 16. Quite obviously, any suitable guide means or jig structure may be employed during the boring operation to insure accurate alignment of the bit 33 during its travel.

Following formation of the core bore 28, the security tube 18 is inserted through the opening 27 in the hinge mount 10 until its inner lock end 19 is disposed as shown in FIG. 5 of the drawings. If the security tube 18 was pre-cut to the appropriate length its outer hinge end 20 will then be disposed slightly outwardly of the outer surface 26 of the hinge mount 10. If individual tubes 18 are being made from longer tube stock then an appropriate tool is used to cut off the inserted security tube 18 to insure the same relationship between the outer end 20 of the security tube and the hinge mount 10. The next step in the assembly of the door lock security reinforcement is the insertion of the positioner element 21 through one of the lock set openings 15 in either of the door panels 3 with the attachment tabs 24 thereof being disposed within the inner end opening 22 of the security tube lock end 19 at which point the two components of the security reinforcement will appear as in FIG. 5 of the drawings. The lock set 6 is thereafter installed within the lock provision 14 with its cylindrical lock case 25 medially disposed between the door knobs 37 and its periphery 38 slightly spaced from the mating inner periphery 39 of the positioner element arcuate arms 23. To facilitate the installation of the lock set 6, it was advantageous to allow the inner lock end 19 of the security tube 18 to remain slightly displaced toward the edge channel 9 of the door until the lock set 6 was completely installed after which the security tube 18 is moved from the position shown in FIG. 5 until the arms 23 are tightly against the periphery 38 of the cylindrical lock case 35.

The installation is completed by the application of a hinge leaf 11, with or without a filler plate therebeneath, upon the recessed hinge mount 10 so as to overlie the outer hinge end 20 of the security tube 18 and to thus preclude outward axial displacement thereof. The hinge leaf 11 is retained in a fixed position by means of the previously mentioned fasteners or screws 29 which engage the hinge mount 10.

With the foregoing description in mind, it will be readily appreciated that an improved arrangement is provided whereby fixed axially extending rigid means engage on the one hand the lock case within the interior of a hollow metal door and on the other hand a fixedly attached hinge leaf such that unwarranted deflection of the lock case and its associated reciprocating bolt is resisted thereby thwarting a forced opening of the door with respect to its surrounding frame.

I claim:

1. In a hollow door having a core filler bounded by two panels and a peripheral edge channel including opposite lock and hinge channels, said panels and lock channel having a lock provision, a lock set within said lock provision and having a lock case between said two panels, said hinge channel having a hinge provision horizontally aligned with said lock provision, the improvement comprising, said hinge provision including a hinge mount having an opening, said core filler provided with a bore extending from adjacent said lock case to said hinge mount opening, an elongated spanner element within said bore having an inner end juxtaposed said lock case and an outer end flush with said hinge mount, a positioner element respectively engaging said lock case and spanner element inner end and means overlying said spanner element outer end and fixed relative said hinge mount to preclude axial displacement toward said hinge channel of said spanner element, positioner element and lock case.

2. A hollow door according to claim 1 wherein, said edge channel and panels are metal and said core comprises an expanded foam material.

3. A hollow door according to claim 1 wherein, said spanner element includes a hollow tube and said bore defines a close sliding fit with said tube.

4. A hollow door according to claim 1 wherein, the longitudinal center axis of said elongated spanner element intersects the transversely extending center axis of said lock case.

5. A hollow door according to claim 1 wherein, said positioner element includes arms engageable with said lock case and attachment means engageable with said spanner element inner end to preclude radial displacement therebetween.

6. A hollow door according to claim 1 wherein, said overlying means includes a hinge leaf.

7. A method of producing a door assembly having an internal lock security reinforcement comprising the steps of selecting a fabricated door having a core filled bounded by two panels and a peripheral edge channel including opposite lock and hinge channels with said panels and lock channel having a lock provision and said hinge channel having a hinge provision horizontally aligned with said lock provision, providing an opening through said hinge provision, forming a bore through said core extending from said opening to said lock provision, introducing an elongated spanner element having inner and outer ends into said bore with said inner end adjacent said lock provision and said outer end adjacent said hinge provision openings, inserting a positioner element having spanner element attachment means into said lock provision between said panels, placing a lock set having a medial lock case within said lock provision with said lock case between said panels and juxtaposed said positioner element, insuring abutting relationship between said lock case, positioner element and inner end of said spanner element with said spanner element outer end flush with said hinge provision, and attaching fixed means in overlying relationship to said hinge provision opening to preclude axial displacement toward said hinge channel of said spanner element, positioner element and lock case.

8. A method as defined in claim 7 wherein, the length of said introduced spanner element is initially of such axial extent that said outer end projects beyond said hinge provision opening, and the step of cutting off said introduced spanner element to provide said outer end flush with said hinge provision opening.

9. A hollow door according to claim 5 wherein, said positioner element is formed as a one-piece element.

10. A hollow door according to claim 5 wherein, said arms are curved to define a constant radius arc and said lock case includes a cylindrical periphery substantially mating with the curvature of said arms.

11. A hollow door according to claim 5 wherein, said attachment means includes a pair of tabs insertable within said spanner element inner end.

* * * * *